US008585839B1

(12) United States Patent
Higa

(10) Patent No.: US 8,585,839 B1
(45) Date of Patent: Nov. 19, 2013

(54) SCALABLE LOW-ENERGY MODIFIED BALL MILL PREPARATION OF NANOENERGETIC COMPOSITES

(75) Inventor: Kelvin T. Higa, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/534,805

(22) Filed: Jun. 27, 2012

Related U.S. Application Data

(62) Division of application No. 13/212,358, filed on Aug. 18, 2011, now Pat. No. 8,231,748.

(51) Int. Cl.

| | |
|---|---|
| ***C06B 45/00*** | (2006.01) |
| ***C06B 45/12*** | (2006.01) |
| ***C06B 45/14*** | (2006.01) |
| ***C06B 33/00*** | (2006.01) |
| ***D03D 23/00*** | (2006.01) |
| ***D03D 43/00*** | (2006.01) |

(52) U.S. Cl.
USPC ... 149/14; 149/2; 149/15; 149/37; 149/108.2; 149/109.2; 149/109.4; 149/109.6

(58) Field of Classification Search
USPC ..... 149/109.2, 109.6, 2, 14, 15, 37, 108.2, 149/109.4
See application file for complete search history.

(56) References Cited

U.S. PATENT DOCUMENTS

2008/0152899 A1* 6/2008 Gangopadhyah et al. .... 428/327
2009/0178742 A1* 7/2009 Dreizin et al. ..... 149/37

OTHER PUBLICATIONS

Fischer, et al. Theoretical energy release of thermites, intermetallics, and combustible metals. 24th international pyrotechnics seminar Monterey, CA Jul. 1998.

* cited by examiner

*Primary Examiner* — James McDonough
(74) *Attorney, Agent, or Firm* — Charlene A. Haley

(57) ABSTRACT

A large-scale synthetic method that enables the preparation of nanoenergetic composites in kilogram scales which forms superior materials as compared to the ultra-sonicated nanoenergetic composites and at a lower cost for use in explosive, pyrotechnic, agent defeat, ammunition primers, and propellant applications.

11 Claims, 11 Drawing Sheets

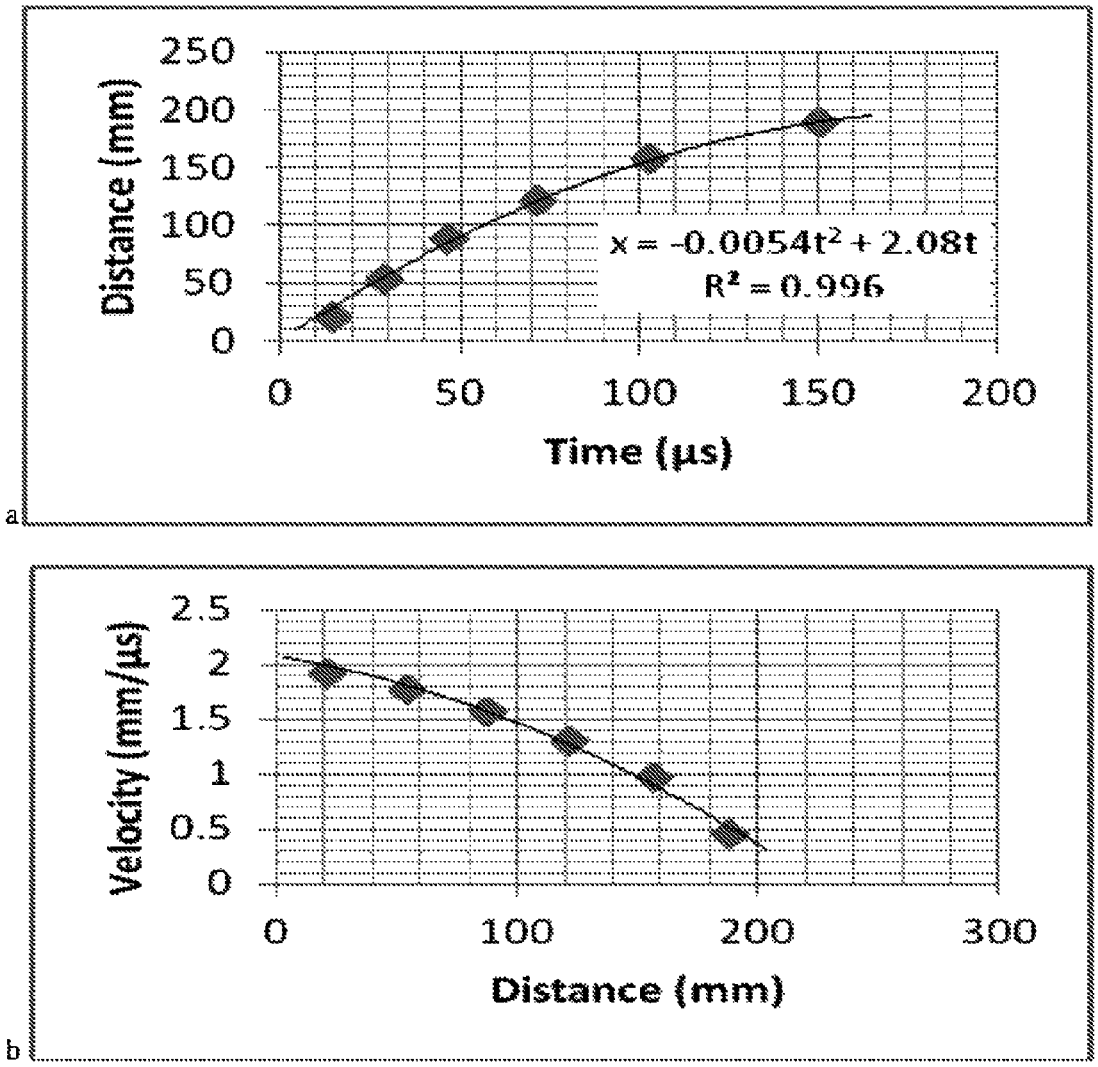
Figures 10 a & b

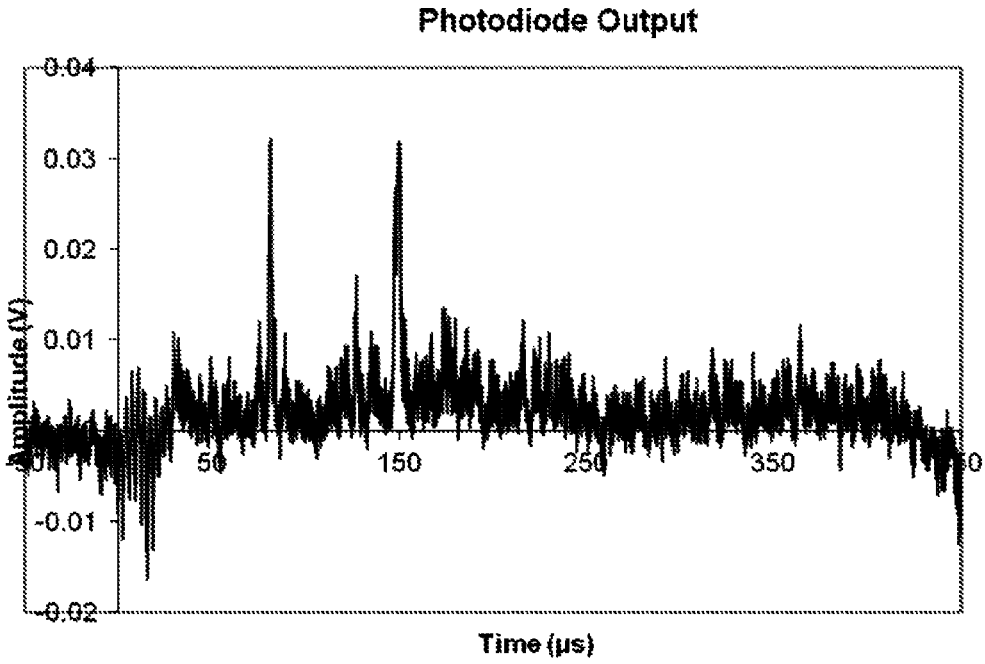
a
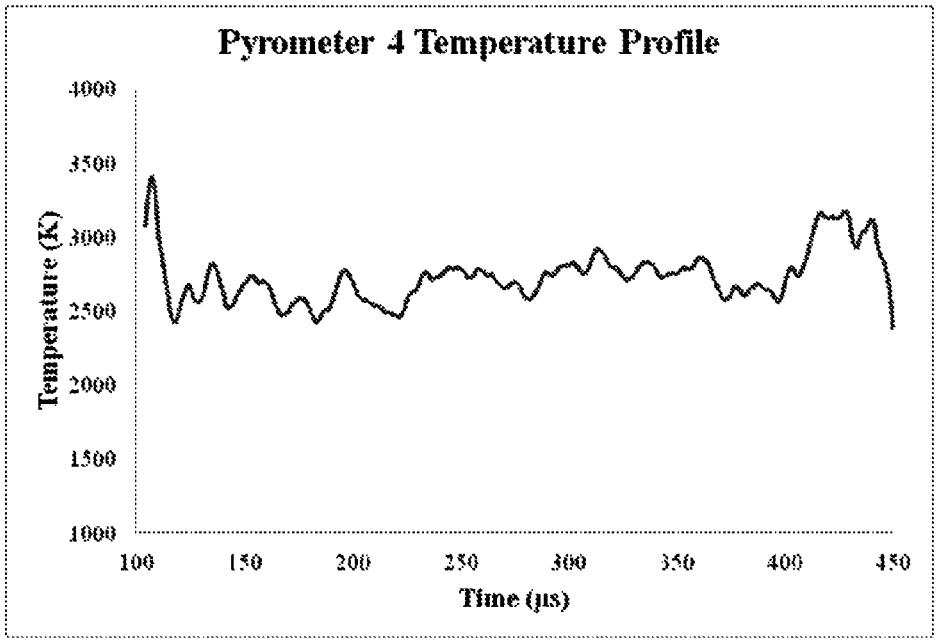
b
Figures 11 a & b

SCALABLE LOW-ENERGY MODIFIED BALL MILL PREPARATION OF NANOENERGETIC COMPOSITES

CROSS-REFERENCE TO RELATED APPLICATIONS

This is a divisional application, claiming the benefit of, parent application Ser. No. 13/212,358 filed on Aug. 18, 2011 now U.S. Pat. No. 8,231,748, whereby the entire disclosure of which is incorporated hereby reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to a large-scale synthetic method that enables the preparation of nanoenergetic composites in kilogram scales which forms superior materials as compared to the ultra-sonicated nanoenergetic composites and at a lower cost for use in explosive, pyrotechnic, agent defeat, ammunition primers, and propellant applications.

BRIEF DESCRIPTION OF THE DRAWINGS

FIGS. 10*a* and *b* are graphs illustrating; (a) The distance-time trajectory of the reaction wave in the nanothermite, (b) The calculated reaction wave velocity, according to embodiments of the invention.

FIGS. 11*a* and *b* are graphs illustrating (a) The response of the photodiode in position 1; signal spikes were observed but they did not correspond to any responses of the piezoelectric pins; and (b) The temperature as determined by the pyrometer at position 5, according to embodiments of the invention.

Figure 1:
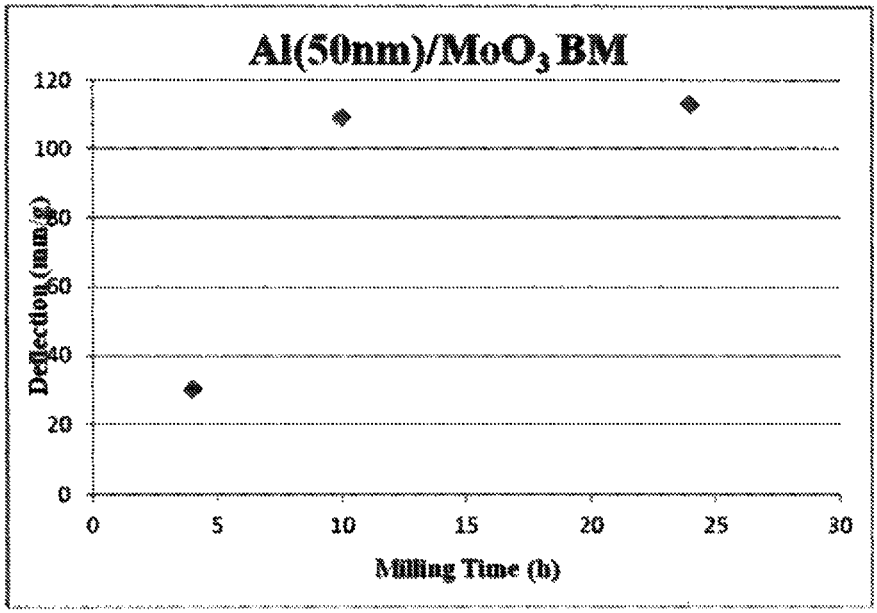
FIG. 1 is a graph illustrating the deflection vs milling time for ball milling preparation of Al(50 nm)/$MoO_3$, according to embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF THE EMBODIMENTS OF THE INVENTION

Embodiments of the invention generally relate to a large-scale synthetic method that enables the preparation of nanoenergetic composites in kilogram scales which forms superior materials as compared to the ultra-sonicated nanoenergetic composites and at a lower cost for use in explosive, pyrotechnic, agent defeat, ammunition primers, and propellant applications.

Embodiments of the invention generally relate to methods for manufacturing energetic composites including, utilizing a modified ball milling process within a chamber capable of producing energetic composites greater than 2 grams, where the chamber includes of high density polyethylene and having at least one friction control mechanism, adding in the chamber at least one submicron sized metal fuel powder and at least one oxidizer powder and at least one non-polar solvent, and placing chamber on a rotation device having a rotation rate of about 60 to about 200 rpm depending on fuel and oxidizer materials utilized.

In embodiments of the invention, the milling balls are constructed of materials having, but not limited to, ceramic, metal, or metal alloy including steel. In embodiments, the chamber has a soft walled material including polyethylene. In other embodiments, the chamber has a soft walled material including high density and low density polyethylene. In yet other embodiments, the chamber has a soft walled material including plastics, rubbers, and fluoropolymers including Teflon®.

In embodiments, the metals include, but are not limited to, at least one of titanium, boron, magnesium, aluminum, zinc, zirconium, and/or hafnium. In other embodiments, the metals include, but are not limited to, particle sizes having ranges of about 33 nm to about 200 nm. IN embodiments, the metal-oxides includes, but is not limited to, at least one of $MoO_3$, $Bi_2O_3$, $AgIO_3$, $Ag_2O$, $Ag_2MoO_4$, CuO, $Fe_2O_3$, $Fe_3O_4$, $MnO_2$, $Bi(IO_3)_3$, $MIO_3$ (M=Li, Na, K), $I_2O_5$, and/or $I_2O_6$. In other embodiments, the metal-oxides includes, but is not limited to, particle sizes having ranges of about 10 nm to about 10 microns.

In embodiments, the non-polar solvent includes, but is not limited to, at least one organic solvent including hexane(s). In other embodiments, the non-polar solvent includes, but is not limited to, alkanes, aromatics, fluorocarbons solvents, and/or acetones. In embodiments, the friction control mechanism includes, but is not limited to, electrical tape. Embodiments of the invention generally relate to the scalable energetic composites produced by the methods above.

Nanoenergetic Composites (NEC) is of interest to the DOD for application in non-lethal weapons, lead-free ammunition primers, igniters, reactive bullets, low collateral damage weapons, miniature weapons, flares, pyrotechnics, and selectable output warheads. Nanoenergetic materials have been prepared by a number of different processes including ultra-sonification, sol-gel, Cryostatic-Milling, and Arrested Reactive Milling. These methods have been used to prepare 0.5 to 10 grams of material per batch. In general, these materials are extremely reactive, highly energetic, impact sensitive, friction sensitive and extremely electrostatic discharge sensitive. The hazards associated with working with these materials makes the "scale-up" process extremely difficult and dangerous.

A NAVAIR SBIR entitled, "Low-Cost Preparation of Super-Thermites", N08-20, was initiated to safely produce large scale quantities of nanostructure energetic materials. Contracts were awarded to investigate four different approaches including cryostatic milling, aqueous mixing, cold rolling forming alternating nanolayers of fuel and oxidizer, and Arrested Reactive Milling. The Cryostatic Milling project was selected for a Phase II effort but to date, the largest batch size is still only 10 gram. Thus far, the materials made from alternative methods do not match the performance of materials prepared by the ultra-sonication method.

Ultra-sonication:

Most organizations including the NAVY make NECs using a 400 Watt Ultrasonic Horn. Nano metal powders are mixed with nano oxidizer powders in hexane, alcohol or water using sonic energy from the horn. The NAVY had also prepared the material using an ultra-sonic cleaning bath.

Ball Milling:

This area is led by Dr. Edward Dreizin at the New Jersey Institute of Technology using a technique called "Arrested Reactive Milling". Micron sized metal powders and oxidizers are ball milled in hexane in steel vessels in 0.5-5 gram scale. Nanostructured energetic materials have been prepared by ball milling micron metal powders (Al, B, Ti) with micron- and nano-powder oxidizers ($MoO_3$, $Bi_2O_3$, CuO, and $Fe_2O_3$) in steel or ceramic vessels. The optimal milling time is generally less than 8 hours and the material performance degrades with longer milling time due to premature reaction of the metal with the oxidizer. The effectiveness of this approach is limited in that these materials do not react as rapidly and do not produces peak pressures observed for nanoenergetic composites made by ultra-sonication methods. In addition, some materials made this way perform very poorly or age rapidly. The milling process forms nanostructured materials that are very reactive. Under a Small Business Innovative Research contract (SBIR) with Physical Sciences Inc., nanostructured material was prepared by cryostatic milling and has just achieved a 10 gram scale level. Some materials prepared by this process exhibit reaction rates close to sonicated materials.

Cold Rolling:

In this technology, oxidizers are layered between sheets of metal and the material is rolled and folded. The process is repeated until a nanostructured energetic material is formed.

Embodiments of the Invention

The new scale-up process implements the use of submicron sized metal and oxidizer powders in hexane, steel or ceramic milling balls, a soft walled vessel (polyethylene bottles) and a slow rotation rates. The ceramic or steel chamber is replaced with a low cost high density polyethylene bottle and milling is performed of a roller rate of about 60-120 rotations per minute. The mass density of High-density Polyethylene can range from 0.93 to 0.97 g/cm$^3$. Although the density of HDPE is only marginally higher than that of Low-density_polyethylene, HDPE has little branching, giving it stronger intermolecular forces and tensile strength than LDPE. The difference in strength exceeds the difference in density, giving HDPE a higher specific strength. It is also harder and more opaque and can withstand somewhat higher temperatures (120° C./248° F. for short periods, 110° C./230° F. continuously).[http://en.wikipedia.org/wiki/High-density_polyethylene] The two milling ball media examined was alumina and steel. The soft walls inhibit premature fuel-oxidizer reactions and permit efficient mixing. Unlike the convention ball milling process where material degradation occurs in less than 8 hour, materials reach optimal performance after 36 hours and do not degrade at longer milling times (96 hours). More importantly, using the Al Pan Dent Test (developed at NAWCWD), these materials appear to form superior materials as compared to the ultra-sonicated nanoenergetic composites. The process is easily scalable and high performance Al/$MoO_3$, Al/$Bi_2O_3$, and Al/$AgIO_3$ composites have been made on 10, 20 and 100 gram scales. The nanoenergetic composites have been prepared and the material performance evaluated using the Al Pan Dent Test.

Starting components are powders of Al having a particle size of 50 to 150 nm and oxidizers ($MoO_3$, $Bi_2O_3$, and $AgIO_3$) having nanosized particles of about 40 nm to 10 μm. The Al/Oxidizer in hexane is milled using milling media (stainless steel or alumina balls) in a softwalled vessel.

Embodiments of the invention enable the safe, low cost, large-scale preparation of high performance nano-energetic composites (NEC) also known as Super-Thermites, Meta-Stable Interstitial Composites, and Nanoenergetic Material. Alternative methods have yet to produce materials of equivalent performance. This method is easily scalable to kilogram quantities and requires very little labor/man hours as opposed to current methods. The current standard method used to prepare NECs is the ultra-sonication of 0.5 to 2 grams of fuel-oxidizer composites. This scale-up process could reduce the cost down to about 70% per kilogram. Materials prepared by this scale-up method are often superior to nanoenergetic materials prepared by the standard ultra-sonication method. This new method enables the preparation of nano-energetic composites in large volumes for application in many Department of Defense (DoD) weapon systems. These materials are of interest because of their high energy content. Some advantages include, but are not limited to: lower cost, scalable for large scale preparation, high performance materials, and suitable for most fuel-oxidizer nanocomposites.

Bulk NEC Preparation by Modified Ball Milling

The ball milling of mixtures of micron aluminum and oxidizer powders are well documented in the literature. Under standard ball milling conditions, even micron composites begin to react after a certain level of milling and milling time (<4 h). Due to the high surface area and high impact and friction sensitivity of nano energetic composites, conventional ball milling may be extremely hazardous. To mitigate some of the hazard, mixtures of nano fuels and nano oxidizers were ball milled in HD polyethylene container. Scale sizes started at 2 gram and were increased to over 100 grams per batch. The milling time, ball to product ratio (BPR), milling media (alumina and steel), and milling media size were investigated. The Al Pan Dent Test was used to monitor the material during milling. A US Stoneware roller was used for all milling experiments. A summary of Ball Milling Experiments is found in Table 1.

TABLE 1

Ball Milling Runs

| Sample Number | Aluminum | Oxidizer | Wt % Al | BPR | Al/ Oxid | Milling Time (h) | Deflection (mm/g) | Scale | MB |
|---|---|---|---|---|---|---|---|---|---|
| Z2 | Al(50 nm) | $MoO_3$ (45 nm) | 49.0% | 2.14 | 3.28 | 24 | 113 | 12 | C 0.5" |
| X67 | Al(80 nm) M2453 | $MoO_3$ (45 nm) | 33.7% | 2.56 | 2.20 | 23 | 200 | 10 | C 0.5" |
| Z5 | Al(80 nm) M2210 | $MoO_3$ (45 nm) | 39.0% | 2.55 | 2.52 | 17 | 154 | 10 | C 0.5" |
| AF139 | Al(80 nm) M2210 | $MoO_3$ (45 nm) | 40.5% | 4.00 | 2.69 | 72 | 212 | 100 | SS 5 mm |
| Z18 | Al(80 nm) M2453 | $MoO_3$ (45 nm) | 39.0% | 1.28 | 2.76 | 17 | 132 | 20 | C 0.5" |
| AF20 | Al(80 nm) M2671 | $MoO_3$ (45 nm) | 40.0% | 10.00 | 2.76 | 24 | 187 | 10 | SS 5 mm |
| AF14 | Al(80 nm) M2671 | $MoO_3$ (45 nm) | 40.0% | 0.26 | 2.8 | 96 | 219 | 100 | C 0.5" |
| AF16 | Al(80 nm) M2671 | $MoO_3$ (45 nm) | 40.3% | 4.10 | 2.8 | 36 | 216 | 100 | SS 5 mm |
| AF17 | Al(80 nm) M2671 | $MoO_3$ (45 nm) | 40.4% | 4.07 | 2.8 | 72 | 212 | 101 | SS 5 mm |
| AD27 | Al(80 nm) M2210 New | $MoO_3$ (45 nm) | 40.5% | 0.26 | 2.87 | 84 | 173 | 100 | C 0.5" |
| AB2 | Al(80 nm) M2453 | $MoO_3$ (45 nm) | 40.3% | 1.05 | 2.92 | 24 | 167 | 24 | C 0.5" |
| Z43 | Al(80 nm) M2210 | $Bi_2O_3$ (50 nm) | 15.0% | 2.56 | 2.25 | 8 | 417 | 10 | C 0.5" |
| AE77 | Al(80 nm) M2671 | $AgIO_3$ (236 nm) | 22.0% | 4.00 | 2.51 | 14 | 970 | 100 | SS 5 mm |
| AE84 | Al(80 nm) M2671 | $AgIO_3$ (266 nm) | 21.8% | 4.00 | 2.48 | 16 | 1100 | 100 | SS 5 mm |
| AE85 | Al(80 nm) M2671 | $AgIO_3$ (266 nm) | 21.8% | 4.00 | 2.51 | 24 | 1091 | 100 | SS 5 mm |
| AE86 | Al(80 nm) M2671 | $AgIO_3$ (266 nm) | 21.8% | 4.00 | 2.51 | 16 | 1112 | 100 | SS 5 mm |
| AE95 | Al(80 nm) M2671 | $AgIO_3$ (277, 276, 271 nm) | 20.0% | 4.00 | 2.54 | 24 | 1291 | 100 | SS 5 mm |
| AE87 | Al(80 nm) M2671 | $AgIO_3$ (277 nm) | 21.8% | 4.00 | 2.51 | 7 | 1235 | 100 | SS 5 mm |
| AE88 | Al(80 nm) M2671 | $AgIO_3$ (277 nm) | 21.8% | 4.00 | 2.51 | 22 | 1230 | 100 | SS 5 mm |
| AE89 | Al(80 nm) M2671 | $AgIO_3$ (277 nm) | 21.8% | 4.00 | 2.51 | 24 | 1308 | 100 | SS 5 mm |
| AE90 | Al(80 nm) M2671 | $AgIO_3$ (277 nm) | 21.8% | 4.00 | 2.51 | 23 | 1297 | 100 | SS 5 mm |
| AE91 | Al(80 nm) M2671 | $AgIO_3$ (277 nm) | 21.8% | 4.00 | 2.51 | 24 | 1257 | 100 | SS 5 mm |
| AE92 | Al(80 nm) M2671 | $AgIO_3$ (277 nm) | 22.2% | 4.00 | 2.54 | 24 | 1291 | 100 | SS 5 mm |
| AE73 | Al(80 nm) M2671 | $AgIO_3$ (474 nm) | 22.0% | 4.00 | 2.50 | 6 | 1236 | 100 | SS 5 mm |
| AE53 | Al(80 nm) M2210 | $AgIO_3$ (632 nm) | 23.0% | 4.10 | 2.32 | 24 | 1035 | 100 | SS 5 mm |
| AE72 | Al(80 nm) M2671 | $AgIO_3$ (632 nm) | 23.0% | 4.10 | 2.65 | 5 | 1031 | 100 | SS 5 mm |
| AB68 | Al(Alex) | $MoO_3$ (45 nm) | 33.0% | 2.56 | 2.23 | 96 | 175 | 10 | C 0.5" |
| AB63 | Al(Alex) | $MoO_3$ (45 nm) | 35.0% | 2.56 | 2.44 | 72 | 183 | 10 | C 0.5" |
| AB72 | Al(Alex) | $MoO_3$ (45 nm) | 36.0% | 2.56 | 2.55 | 120 | 185 | 10 | C 0.5" |
| AB60 | Al(Alex) | $MoO_3$ (45 nm) | 37.0% | 2.56 | 2.67 | 75 | 223 | 10 | C 0.5" |
| AB70 | Al(Alex) | $MoO_3$ (45 nm) | 38.0% | 2.40 | 2.77 | 120 | 208 | 10.65 | C 0.5" |
| AB58 | Al(Alex) | $MoO_3$ (45 nm) | 39.0% | 2.56 | 2.89 | 39 | 166 | 10 | C 0.5" |
| Z82 | Al(Alex) | $MoO_3$ (45 nm) | 40.0% | 2.56 | 3.02 | 72 | 158 | 10 | C 0.5" |
| AB77 | Al(Alex) | $AgIO_3$ (156 nm) | 20.0% | 5.12 | 2.23 | 63 | 756 | 10 | C 0.5" |
| AB78 | Al(Alex) | $AgIO_3$ (320 nm) | 20.0% | 5.12 | 2.23 | 75 | 769 | 10 | C 0.5" |

Table 1: Ball Milling Runs the Ball to Product Ratio (BPR) was varied from 0.25 to over 5 and only affected the amount of milling time required. The ball milling material did not impact the material performance. Both alumina (C=ceramic) and stainless steel (SS 5 mm) milling balls gave high performing NECs. However, the alumina balls were found to pick up charge during the milling process and resulted in 2 separate fires during the isolation of the products. The use of ceramic milling balls capable of picking up charge by triboelectric charging is not advisable. For the Al(80 nm)/$AgIO_3$ NEC system, there appears to be an optimum $AgIO_3$ particle size centered around 277 nm. For the Alex/$MoO_3$(45 nm) NEC system, the optimal Al/$MoO_3$ molar ratio was 2.67 and gave a Deflection of 223 mm/g. The ball milled NEC products are in many cases superior to small scale sonication materials with the same composition.

Figure 2:
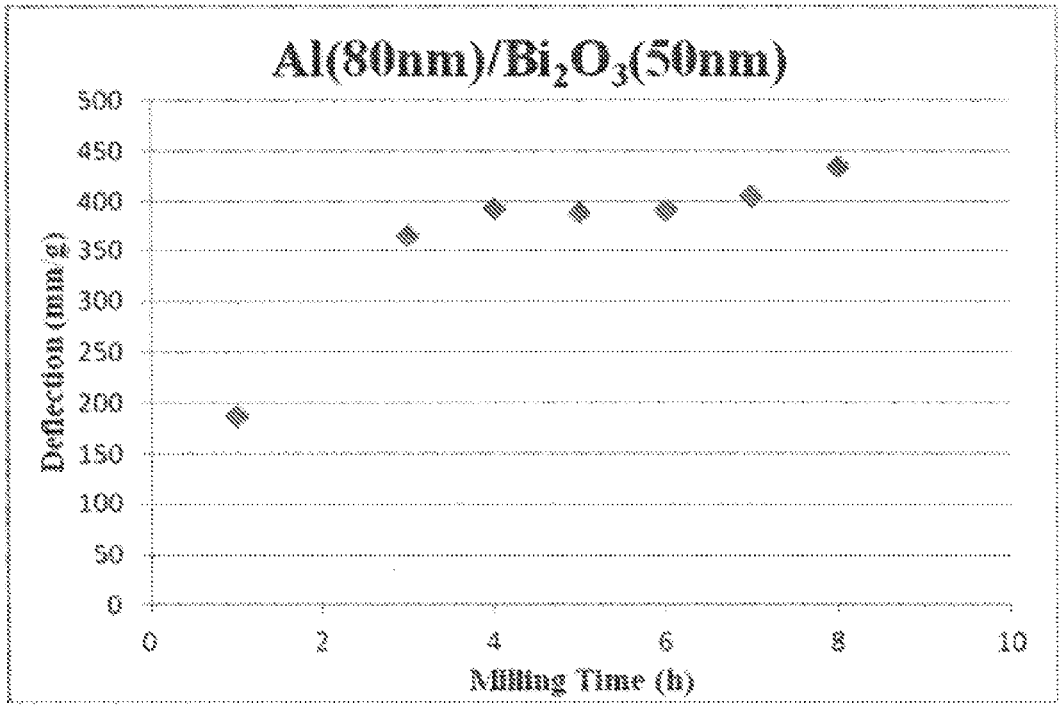
FIG. 2 is a graph illustrating the deflection vs mill time for Al(80 nm)$Bi_2O_3$(50 nm), according to embodiments of the invention.
Figure 3:
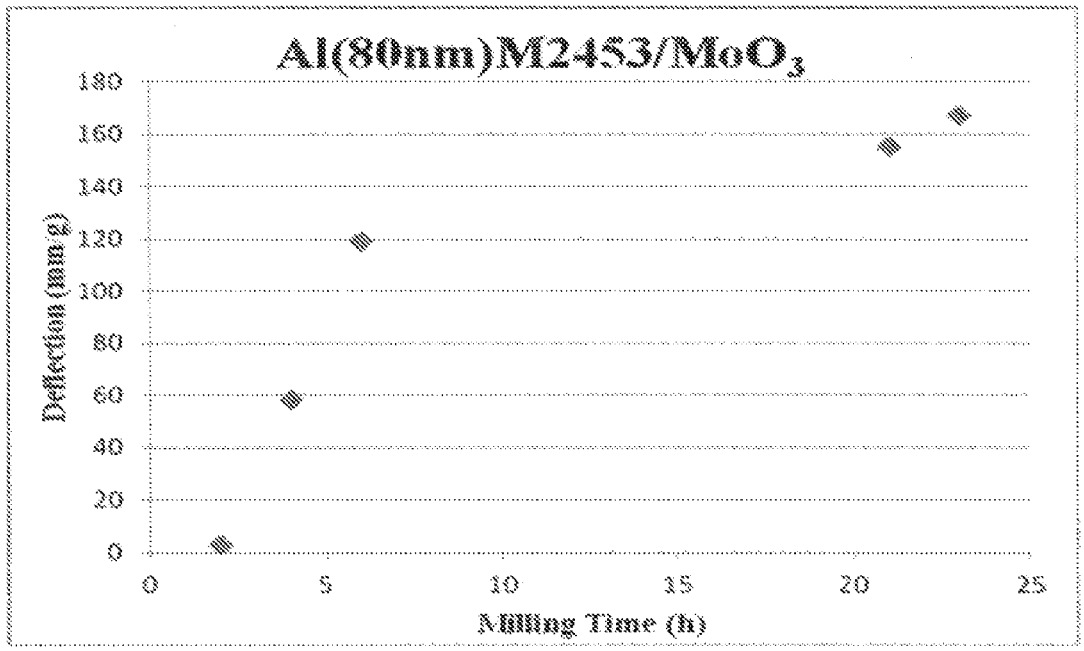
FIG. 3 is a graph illustrating the deflection vs mill time for Al(80 nm)/$MoO_3$(45 nm), according to embodiments of the invention.
Figure 4:
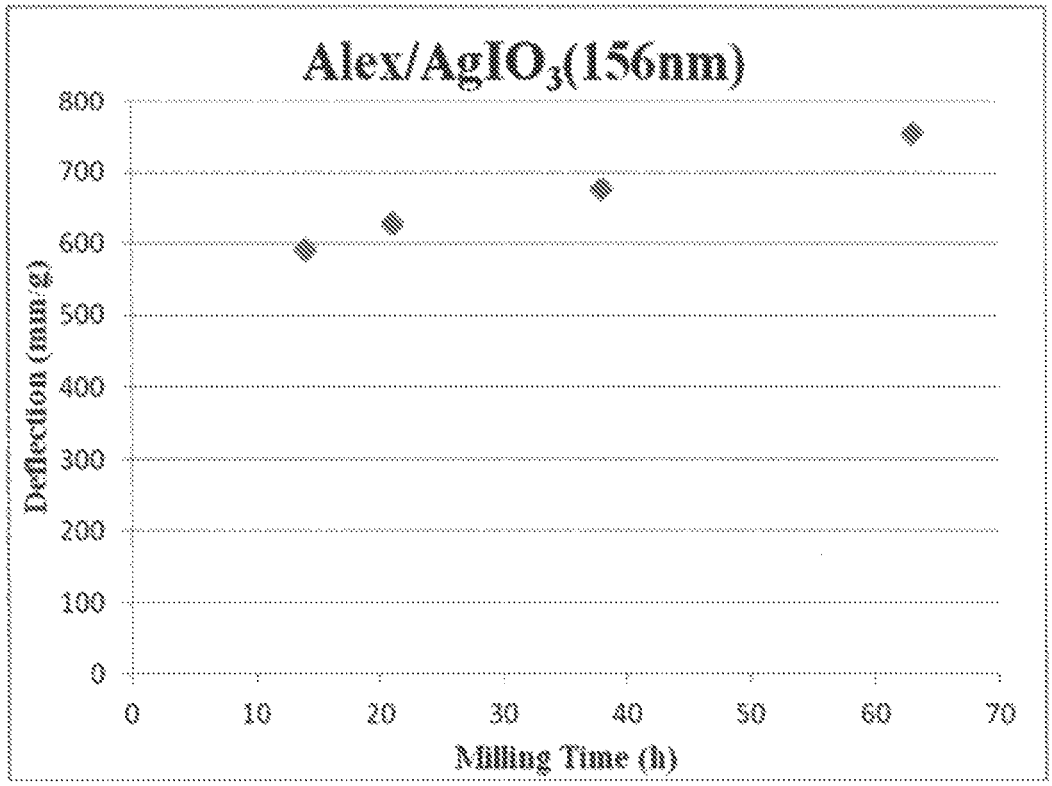
FIG. 4 is a graph illustrating the deflection vs mill time for Al(80 nm)/$AgIO_3$(156 nm), according to embodiments of the invention.

Al(5 nm)/$MoO_3$(45 nm)—The 250 ml PE milling bottle was charged with 5.86 g of 50 nm Al, 6.10 g of $MoO_3$, 53 ml of hexane and 10 alumina milling balls (0.5" diameter, 25.6 g). The composite composition was 49 wt % Al(50 nm) and 51 wt % $MoO_3$ that corresponds to a 3.28 Al/$MoO_3$ molar ratio. The BPR was 2.14. The roller was set to 50% power and aliquots were removed periodically and evaluated using the Al Pan Dent Test. The Deflection versus milling time is shown in FIG. 1. FIG. 1: Deflection Versus Milling Time for Ball Milling Preparation of Al(50 nm)/$MoO_3$ After 24 h the milling was stopped and a "Deflection" of 113 mm/g was obtained which was consistent with KTHY7H (112 mm/g) that was prepared by sonication. FIG. 2: Deflection Versus Mill Time for Al(80 nm)/$Bi_2O_3$(50 nm). FIG. 3: Deflection Versus Mill Time for Al(80 nm)/$MoO_3$(45 nm). FIG. 4: Deflection Versus Mill Time for Al(80 nm)/$AgIO_3$ (156 nm).

Al(50 nm)/$MoO_3$(45 nm) KTHZ2—12 g Scale

A 250 ml PE bottle was loaded with 5.86 g of 50 nm Al powder, 6.10 g of $MoO_3$(45 nm) powder, 50 ml of hexane and 10 alumina balls (26 g). The bottle was wrapped with electrical tape to increase friction between the roller and the bottle. The bottle was placed on a US Stoneware Roller set at 50% power. Samples of the product were removed periodically and tested using the Al Pan Dent Test. The mixing was stopped once the deflection stabilized.

Figure 5:
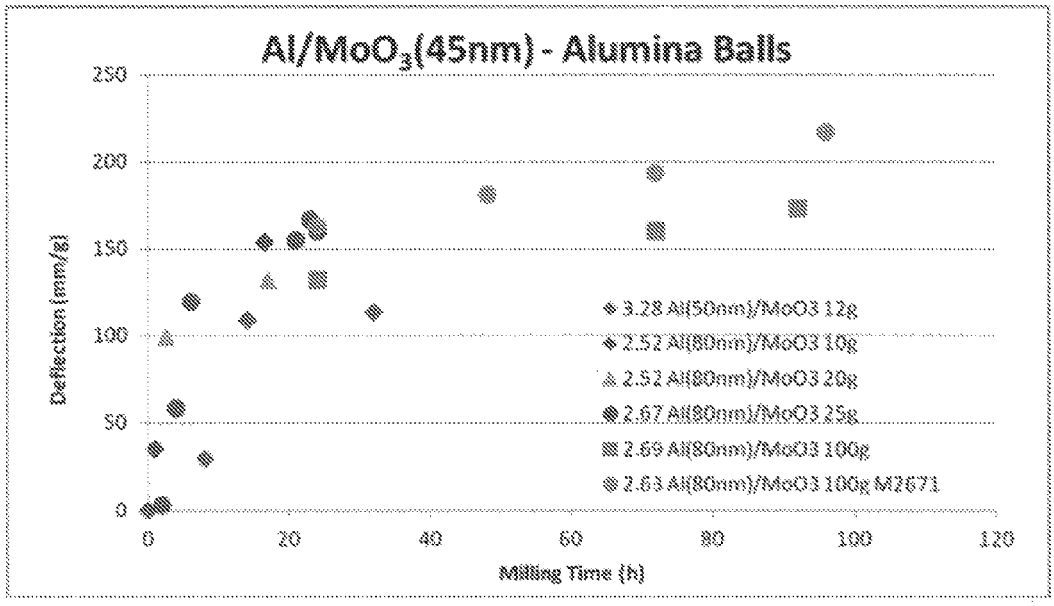
FIG. 5 is a graph illustrating the modified ball milling using alumina ball milling media, according to embodiments of the invention.

FIG. 5: Modified Ball Milling Using Alumina Ball Milling Media

The effect of changing the milling media from alumina to stainless steel was investigated. The alumina balls are porous with a diameter of 12.5 mm and density of 2.21 g/cc as compared to the stainless steel balls with a diameter of 5 mm and density of 7.86 g/cc. The three samples all used the same starting materials, 80 nm Al (lot M2671) and $MoO_3$(45 nm). The compositions were kept nearly constant but the Ball to Product Ratio (BPR) varied along with the amount of material. Due to the low density of the alumina balls high BPRs were not possible and for the 100 g run the BPR was 0.55. This led to an almost linear increase in deflection versus milling time but it required 4 days to exceed 200 mm/g deflection. In contrast, the 100 g run using stainless steel reached over 200 mm/g is less than 36 hours. For a smaller 10 g run using stainless steel and a higher BPR of 10 exhibited an even faster rise in deflection versus time. The faster rise is due to smaller size and higher BPR. The shorter milling time was expected due to the higher density of steel (7.86 g/cc) versus porous alumina (2.21 g/cc). A safety issue was found relating to the use of ceramic milling balls. During the milling process, the milling balls pick up charge via tribo-electric charging. In one case, a grounded spatula ignited a ceramic milling ball causing a small fire.

Figure 6:
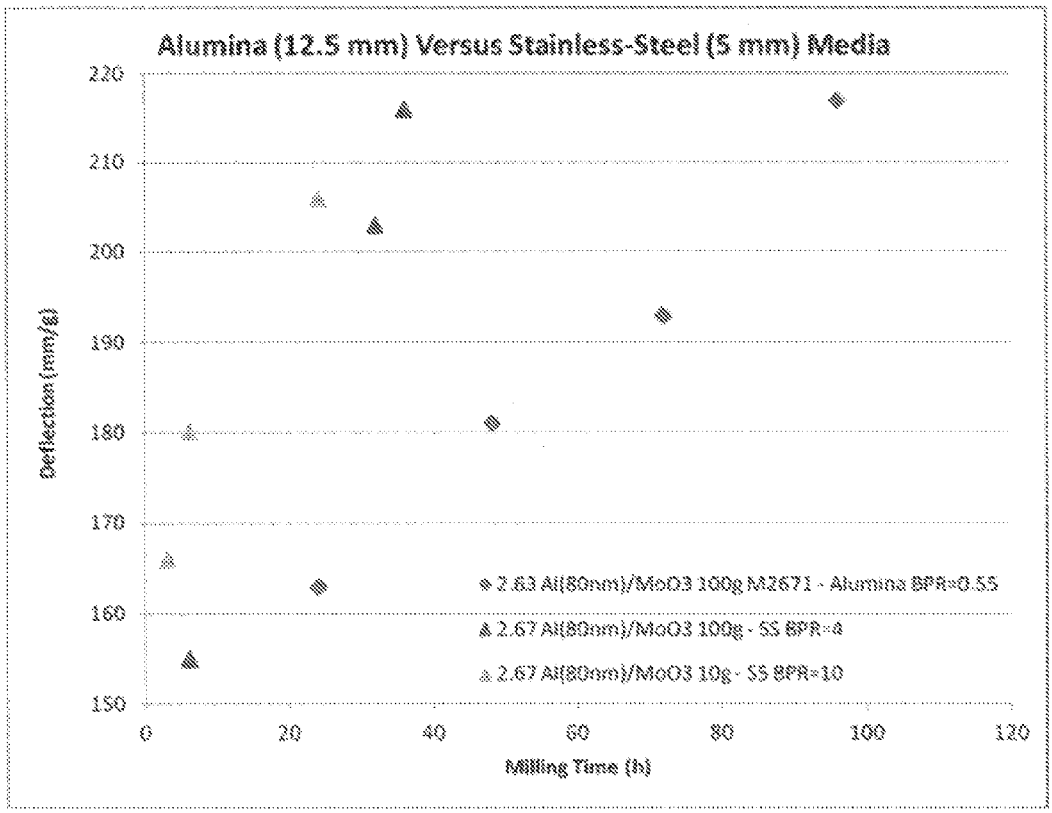
FIG. 6 is a graph illustrating the Alex/$MoO_3$(45 nm) NECs made by sonication and ball mill, according to embodiments of the invention.

FIG. 6: Alumina Versus Stainless Steel Media.

Additional modified ball milling runs for Alex/$MoO_3$, Al(80 nm)/$Bi_2O_3$, and Al(80 nm)/$AgIO_3$.

The Al Pan Dent Test deflection for almost every NEC prepared by NAWCWD's Modified Ball Milling process is equal or better than the best result obtained by the conventional small scale sonication process. In addition, LANL compared Al(80 nm)/$MoO_3$ prepared by sonication and modifed ball mill in their pressure cell and found that the ball milled product gave a slightly higher peak pressure and higher impulse.

NAWCWD's Ball Milling process has been scaled up from 10 g to 100 g with no difficulty. Further scaling to many kilograms is possible but should be done by the industry. The NEC product from the bulk milling process is also superior to the small scale sonication method Table 2:

TABLE 2

NECs Prepared by Sonication and Modified Ball Miling

| Name | Composite | Al/Oxidizer Ratio | Deflection (mm/g) | Method |
|---|---|---|---|---|
| Y46F | Al(80 nm)/$MoO_3$(45 nm) | 2.67 | 154 | Sonic |
| AF14 | Al(80 nm)/$MoO_3$(45 nm) | 2.67 | 217 | BM |
| Y17 | Al(80 nm)/$Bi_2O_3$(320 nm) | 2.27 | 513 | Sonic |
| AB3 | Al(80 nm)/$Bi_2O_3$(320 nm) | 2.26 | 486 | BM |
| AD32 | Al(80 nm)/$AgIO_3$(271 nm) | 2.14 | 1095 | Sonic |
| AE80 | Al(80 nm)/$AgIO_3$(277 nm) | 2.19 | 1308 | BM |
| | | Wt Ratio | | |
| AB68 | Alex/$MoO_3$(45 nm) | 33/67 | 175 | BM |
| AB63 | Alex/$MoO_3$(45 nm) | 35/65 | 183 | BM |
| AB72 | Alex/$MoO_3$(45 nm) | 36/64 | 185 | BM |
| AB60 | Alex/$MoO_3$(45 nm) | 37/63 | 223 | BM |
| AB70 | Alex/$MoO_3$(45 nm) | 38/62 | 211 | BM |
| AB58 | Alex/$MoO_3$(45 nm) | 39/41 | 166 | BM |
| AB82 | Alex/$MoO_3$(45 nm) | 40/60 | 158 | BM |
| Z75 | Alex/$MoO_3$(45 nm) | 40/60 | 11 | Sonic |
| Z79 | Alex/$MoO_3$(45 nm) | 50/50 | 11 | Sonic |
| Z87 | Alex/$Bi_2O_3$(320 nm) | 13.8/86.2 | 469 | Sonic |
| Z81 | Alex/$Bi_2O_3$(320 nm) | 15/85 | 526 | Sonic |
| Z80 | Alex/$Bi_2O_3$(320 nm) | 15.9/84.1 | 397 | Sonic |
| AB91 | Alex/$Bi_2O_3$(320 nm) | 15/85 | 483 | BM |
| AD87 | Alex/$AgIO_3$ City | 20/80 | 2 | Sonic |
| AD88 | Alex/$AgIO_3$ City | 24/76 | 156 | Sonic |
| AD89 | Alex/$AgIO_3$ City | 22/78 | 753 | BM |

For almost every NEC prepared by both sonication and modified ball milling, the milled material is superior and sometimes far superior to sonication. The Al(80 nm)/$AgIO_3$ (277 nm) NEC made by ball milling (1308 mm/g) is by far the best performing material tested to date. The most likely reason for this is that the sonication process does not completely break up agglomerates in hexane and that re-agglomeration also occurs. The ball milling process appears to be more efficient at mixing the agglomerated fuel with the oxidizer. Examination of sonicated and ball milled samples of Al(80 nm)/$MoO_3$ appear to be identical by SEM.

The Alex/$MoO_3$ NEC was optimized using ball milling samples rather than by sonication because the sonicated samples performed so poorly. Based on the hydrolysis data, Alex is 85% active Al and the optimized formulation (AB60) with a 37/63 Alex to $MoO_3$ weight ratio corresponds to a 2.68 to 1 molar ratio. The Al(80 nm)/$MoO_3$ NEC optimized to a 2.67 molar ratio by sonication. The Alex/$MoO_3$ NEC (AB60)

is slightly better than the best Al(80 nm)/$MoO_3$ NEC (AF14). Prior to completing the optimization of Alex/$MoO_3$, a LFEP using the 39/61 Al(Alex)/$MoO_3$ NEC (AB58) was made. The Alex based LFEP included 64.6% AB58, 31.4% AN, 2% Kel-F and 2% C and gave an average ambient AUR-AT of 3.67±0.43 ms and a LT AUR-AT of 4.88±2.26 ms. The high ambient AUR-ATs were probably due to the fact that the Alex/$MoO_3$ NEC was too fuel rich. In all probability, the 37/63 Alex/$MoO_3$ (AB60) based LFEP would have produced much better ambient AUR-ATs. However, the LT AUR-ATs are potentially an issue since Alex includes only small amounts of sub 80 nm particles and ignition delays are probable.

Figure 7:
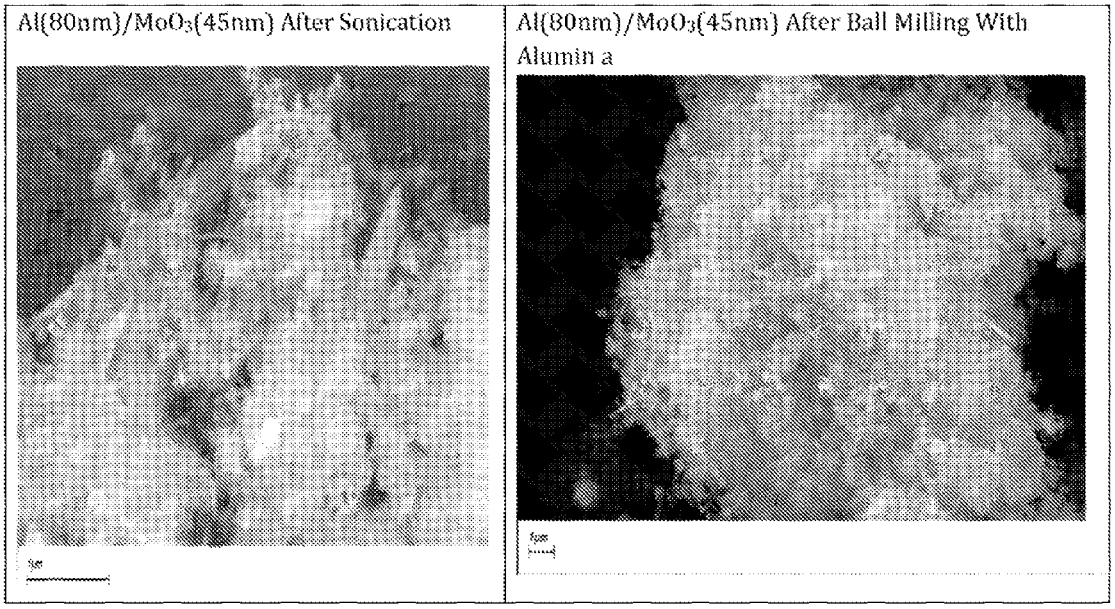
FIG. 7 are photographs illustrating scanning electron micrographs of Al(80 nm)/MoO3(45 mm) NECs made by sonication and ball mill, according to embodiments of the invention.

FIG. 7: Scanning Electron Micrographs of Al(80 nm)/$MoO_3$(45 nm) NECs Made By Sonication and Ball Mill Explosive Behavior of Aluminum and Silver Iodate Nanothermite Mixtures of aluminum and silver iodate were prepared and studied to determine combustion and explosive characteristics. The objective is to gain a better understanding of reaction mechanisms and to assess potential applications of the materials. These materials exhibit explosive behavior, but produce gaseous products that rapidly condense upon cooling. They may be described as condensable gas explosives. A prelimary analysis was conducted on the ability of Al/$AgIO_3$ and Al/$Bi_2O_3$ thermites to generate pressure to do pressure-volume work. The preparation of $AgIO_3$ was scaled to 250-500 g batches, with sizes in the range of 236-474 nm. Aluminum particle size was generally 80 nm. The combustion of powder samples was characterized by a small-scale dent test, a shock initiation test, high speed video imaging, and optical pyrometry. The effect of $AgIO_3$ particle size was studied for the range of 150 nanometers to 2 microns. Video imaging and optical pyrometry results indicated a temperature rise rate of $10^8$ K/s for the reacting Al/$AgIO_3$ nanothermite. A mild ball milling procedure was found to be more effective than sonication of hexane suspensions at producing high performance nanothermites. Shock initiation tests on up to 800 g of nanothermite resulted in deflagration, with no evidence to support a detonation.

The objective of the current investigation is to characterize the reaction mechanisms and explosive properties of Al/$AgIO_3$ thermite, and to assess potential applications. In the first part, results are presented on material preparation and characterization. In the second part, results are described on shock initiation of the Al/$AgIO_3$ nanothermite. The hypothesis tested was that a nanothermite of aluminum and silver iodate could be shock initiated to detonation. Fuel-oxidizer explosive formulations such as aluminum/ammonium nitrate are detonable. [Maranda, A. and Cudzilo, S., "Explosive Mixtures Detonating at Low Velocity," *Propellants, Explosives, Pyrotechnics* 26, 165-167 (2001)] When the constituents are milled to small particle sizes, even the critical diameter for detonation can be reduced to less than one centimeter.

The traditional thermite reaction, where aluminum reacts with iron oxide ($Fe_3O_4$ or $Fe_2O_3$) to form aluminum oxide and molten iron, produces little gas due to the high boiling points of the products and ingredients. Thermite reactions are typically thought of as highly exothermic reactions between a metal and a metal oxide, with the definition often broadened to include non-metal oxides as the oxidizing agent. [Wang, L. L, Munir, Z. A. and Maximov, Y. M., "Thermite Reactions: Their Utilization in the Synthesis and Processing of Materials," *J. Mater. Sci.* 28(14), 3693-3708 (1993); Wikipedia, thermite] Reaction velocities for thermites are highly dependent on particle sizes, and can be on the order of 1 kilometer per second for some nano-scale mixtures, which are frequently referred to as MICs (metastable intermolecular composites). [Danen, W. C. and Martin, J. A., "Energetic Composites," U.S. Pat. No. 5,266,132, Nov. 30, 1993; Bockmon, B. S., Pantoya, M. L., Son, S. F., Asay, B. W. and Mang, J. T., "Combustion Velocities and Propagation Mechanisms of Metastable Interstitial Composites," *J. Appl. Phys.* 98, 064903-1 to 064903-7 (2005); Obrey, S., Pachecho, A. N., Foley, T. J., Higa, K. T. and Johnson, C. E., "Sensitivity, Ignition and Flame Propagation in New Nano-Aluminum Iodate Nanoenergetic Material," in *Proc.* 42$^{nd}$ *JANNAF Combustion Subcommittee Meeting*, Boston, Mass., (May 2008)]

Table 3 lists physical and thermodynamic properties calculated for a few thermite composites along with two conventional explosive compounds, trinitrotoluene (TNT) and lead azide. [Thermodynamic data was generally obtained from the data base at the website http://www.crct.polymtl.ca/reacweb.htm] Literature values for the equilibrium gas production from Al/$MoO_3$ are 1 and 2.4 mmol/cc. [Dutro, G. M., Yetter, R. A., Risha, G. A. and Son, S. F., The Effect of Stoichiometry on the Combustion Behavior of a Nanoscale Al/$MoO_3$ Thermite, Proc. Combustion Inst. 32(2), 1921-1928 (2009); Fischer, S. H. and Grubelich, M. C., "Theoretical Energy Release of Thermites, Intermetallics, and Combustible Metals," in Proc. 24$^{th}$ Intl. Pyrotechnics Seminar (1998)] Large amounts of gas, approaching that of the explosive compounds, can be generated from thermite systems by selecting oxidizers that produce lower boiling products compared to iron (boiling point 3135 K). However, there is a critical distinction in ability to generate high pressure gas that can perform pressure-volume work. The gas produced by thermites is transient.

Upon cooling nearly all of the gas converts to condensed phases. Even at high temperatures, gaseous products may be subject to condensation at elevated pressure, due to thermodynamic equilibration between vapor and condensed phases. Gas condensation reduces the amount of pressure-volume work that can be performed, but may enhance heat transfer to targets. For some energetic material applications this may be acceptable, or even desirable. The work described here is part of a broader effort to examine Al/$AgIO_3$ and other thermite systems for potential applications in the defeat of chemical and biological warfare agents (e.g., anthrax spores), lead-free primers for medium-caliber gun ammunition, and low collateral damage weapons.

In previous reports we have described experimental methods and preliminary results for Al/$AgIO_3$ and some other nano-scale thermite materials. [Obrey, S., Pachecho, A. N., Foley, T. J., Higa, K. T. and Johnson, C. E., "Sensitivity, Ignition and Flame Propagation in New Nano-Aluminum Iodate Nanoenergetic Material," in *Proc.* 42$^{nd}$ *JANNAF Combustion Subcommittee Meeting*, Boston, Mass., (May 2008); Johnson, C. E., Higa, K. T., Albro, W. R., Thompson, D. and Schilling, T. J., "Combustion of Nano Aluminum with Metal Iodates and Metal Oxides," in *Proc.* 42$^{nd}$ *JANNAF Combustion Subcommittee Meeting*, Boston, Mass. (May 2008); Albro, W. R., Lyle, T. M., Atwood, A. I., Johnson, C. E., Higa, K. T. and Rattanapote, M. K., "Ensemble Combustion Studies of Metal Fuels," in *Proc.* 42$^{nd}$ *JANNAF Combustion Subcommittee Meeting*, Boston, Mass. (May 2008); Johnson, C. E., Albro, W. R., Schilling, T. J., Higa, K. T., Gumina, J. M., and Tran, T. T., "Thermite Explosives," in *Proc. 56th JANNAF Propulsion Subcommittee Meeting*, Las Vegas, Nev. (April 2009)] While the focus of this paper is on Al/$AgIO_3$, comparisons are made to the Al/$Bi_2O_3$ nanothermite, which also produces a relatively large amount of gas, and is another candidate for explosive applications. In a 10 g scale blast test, the mass specific impulse for Al/$Bi_2O_3$ nanothermite powder was found to be about 15% of that of TNT. [Johnson, C. E., Higa, K. T., Albro, W. R., Thompson, D. and Schilling, T. J., "Combustion of Nano Aluminum with Metal Iodates and Metal Oxides," in *Proc.* 42$^{nd}$ *JANNAF Combustion Subcommittee Meeting*, Boston, Mass. (May 2008)]

TABLE 3

Selected properties calculated for thermite composites.[a]

| Composition | Density g/cc | $-\Delta H_r^o$ kJ/g | $-\Delta H_r^o$ kJ/cc | Adiabatic Reaction T, K | Gas mmol/cc | Gas Species | T, b.p. or dissoc., K |
|---|---|---|---|---|---|---|---|
| $2\,Al + AgIO_3 \rightarrow Al_2O_3 + AgI$ | 4.74 | 4.65 | 22.0 | ~4000 | 28 + $Al_xO_y$ | Ag + I + $Al_xO_y$ | d 2260 (AgI) |
| $2\,Al + Bi_2O_3 \rightarrow Al_2O_3 + 2\,Bi$ | 7.19 | 2.12 | 15.2 | 3300 | 28 + $Al_xO_y$ | Bi + $Al_xO_y$ | 1837 (Bi) |
| $8\,Al + 3\,Fe_3O_4 \rightarrow 4\,Al_2O_3 + 9\,Fe$ | 4.25 | 3.68 | 15.6 | 3135 | 0.5 | Fe | 3135 |
| $10\,Al + 3\,I_2O_5 \rightarrow 5\,Al_2O_3 + 3\,I_2$ | 4.12 | 6.22 | 25.6 | ~4000 | 36 | I + $Al_xO_y$ | d 1450 ($I_2$) |
| $2\,Al + MoO_3 \rightarrow Al_2O_3 + Mo$ | 3.81 | 4.70 | 17.9 | ~4000 | 1-2.4 | $Al_xO_y$ | ~4000 |
| TNT: $2\,C_7H_5N_3O_6 \rightarrow 3\,N_2 + 7\,CO + 5\,H_2O + 7\,C$ | 1.65 | 4.11 | 6.8 | 2830 | 55 | $N_2 + CO + H_2O$ | 373 ($H_2O$) |
| $Pb(N_3)_2 \rightarrow Pb + 3\,N_2$ | 4.80 | 1.55 | 7.4 | 2380 | 66 | $N_2 + Pb$ | 2022 (Pb) |

[a]The last three columns refer to gaseous products that would form upon adiabatic reaction at atmospheric pressure. In columns 6 and 7, $Al_xO_y$ refers to the multiple gaseous products that form upon vaporization of $Al_2O_3$ (AlO, Al, O, etc.). In the last column, selected boiling points or dissociation temperatures are listed for the products, with "d" indicating a dissociation temperature.

Material Preparation and Characterization

Experimental

Reagents with approximate particle sizes and sources are listed in the following: aluminum powders (80 nm, metallic aluminum content approximately 74%, NovaCentrix), (150 nm, metallic Al content approximately 85%, Alex Al, Argonide); $Bi_2O_3$ (320 nm, Sigma-Aldrich); silver iodate powders (1.8 μm, Noah Technologies), (1200 and 860 nm, City Chemical). The silver iodate from Noah was dried at 343 K, then ball-milled to break up clumps. Particle sizes were usually determined by surface area analysis.

Silver iodate in sizes ranging from 156-477 nm was prepared by precipitation from aqueous solutions of silver nitrate and potassium iodate. [Johnson, C. E., Higa, K. T., Albro, W. R., Thompson, D. and Schilling, T. J., "Combustion of Nano Aluminum with Metal Iodates and Metal Oxides," in *Proc.* 42$^{nd}$ *JANNAF Combustion Subcommittee Meeting, Boston, Mass. (May* 2008); Sendroy, J., "Microdetermination of Chloride in Biological Fluids, with Solid Silver Iodate," *J. Biol. Chem.* 120, 335-403 (1937)] The scale was increased from the previously reported 50 g batches to 250 and 500 g batches using 13 L buckets. A 1.4% molar excess of $KIO_3$ reagent was used. The addition time was 45 s.

Thermite composites were typically prepared on a 1-2 g scale by sonicating hexane suspensions of the powder ingredients. [Johnson, C. E., Higa, K. T., Albro, W. R., Thompson, D. and Schilling, T. J., "Combustion of Nano Aluminum with Metal Iodates and Metal Oxides," in *Proc.* 42$^{nd}$ *JANNAF Combustion Subcommittee Meeting*, Boston, Mass. (May 2008)] After 2 minutes of sonication, the product was filtered through filter paper and the resulting cake broken up into a fine powder using a grounded metal spatula. The product was transferred into a conductive polyethylene vial and dried under vacuum for 1 h.

The $Al/AgIO_3$ nanothermite was prepared on a 100 g scale by ball milling the powder ingredients suspended in hexanes. A 1 L polyethylene bottle was loaded with 22.1 g of 80 nm Al, 78.5 g of $AgIO_3$, 1.4 kg of 5 mm steel milling balls, and 600 mL of hexanes. The capped bottle was placed on a roller and rotated for 16-24 h. The solid product and part of the hexanes were transferred to a 250 mL polyethylene bottle and stored at room temperature until use. The samples were monitored to ensure that the solid was covered with hexanes at all times.

Energetic nanocomposites in general should be handled with extreme care. These materials are often as sensitive as common primary explosives, such as lead azide and lead styphnate. Table 4 lists safety sensitivity data for some compositions. The nanothermites are highly sensitive to initiation by both electrostatic discharge (ESD) and friction.

TABLE 4

Safety sensitivity test results.

| Composite | ESD Sensitivity[a] mJ | Friction Sensitivity[b] N or lb |
|---|---|---|
| Al (80 nm) + $AgIO_3$ (235 nm) | 0.009-0.90 | fired at 0.05 N |
| Al (80 nm) + $Bi_2O_3$ (320 nm) | 0.004-0.225 | fired at 0.05 N |
| PETN[c] | 10/10 no fire | 174-224 lb |

[a]Materials that do not initiate at 250 millijoules (standard test conditionwith 5000 volt spark) are considered to be insensitive to electrostatic discharge.
[b]Sliding friction sensitivity tests were conducted using a small BAM (Buridesanstalt fur Materialprufungen) tester with sliding ceramic parts(results in newtons (N)), or by using the Allegany Ballistics Laboratory (ABL) method with sliding metal parts (results in pounds (lb)).
[c]Data for PETN (pentaerythritol tetranitrate) provided for reference.

High-speed digital video imaging was conducted with a Phantom v9.1 camera.

Results and Discussion

As discussed in the introduction section, the pressure-volume work capabilities of nanothermites with condensable gas products will be reduced in comparison to conventional organic explosives like TNT. In this section, consider briefly was the chemistry of the $Al/AgIO_3$ reaction, and provide rough calculations of possible pressures and temperatures under limiting conditions. [Johnson, C. E., Albro, W. R., Schilling, T. J., Higa, K. T., Gumina, J. M., and Tran, T. T., "Thermite Explosives," in *Proc. 56th JANNAF Propulsion Subcommittee Meeting*, Las Vegas, Nev. (April 2009)] A chemical reaction scheme for the $Al/AgIO_3$ system is given below in Scheme 1. The first part of the scheme lists the expected initial responses of the ingredients to heating, while the second part lists the hot equilibrium products of adiabatic reaction (at atmospheric pressure) along with their expected behavior upon cooling. The initial thermal event for the reactants is probably the melting and decomposition of $AgIO_3$, which occurs at 750 K under slow heating conditions (from thermogravimetric analysis under $N_2$ atmosphere), and at 1170 K when heated about $5\times10^5$ K/s. [Sullivan, K. T., Piekiel, N. W., Chowdhury, S., Wu, C., Zachariah, M. R., and Johnson, C. E., "Ignition and Combustion Characteristics of Nanoscale Al/$AgIO_3$: A Potential Energetic Biocidal System," *Combustion Science and Technology,* 183(3), 285-302 (2011)] Ignition of the Al/$AgIO_3$ nanothermite was observed at 1215+/−40 K on a wire heated about $5\times10^5$ K/s. [Sullivan, K. T., Piekiel, N. W., Chowdhury, S., Wu, C., Zachariah, M. R., and Johnson, C. E., "Ignition and Combustion Characteristics of Nanoscale Al/$AgIO_3$: A Potential Energetic Biocidal System," *Combustion Science and Technology,* 183(3), 285-302 (2011)] Nano Al combustion with oxygen or water vapor has been reported to commence in the temperature range 800-1000 K for slow to fast heating rates. [Johnson, C. E., Fallis, S., Chafin, A. P., Groshens, T. J., Higa, K. T., Ismail, I. M. K., and Hawkins, T. W., "Characterization of Nanometer- to Micron-Sized Aluminum Powders: Size Distribution from Thermogravimetric Analysis," *Journal of Propulsion and Power,* 23(4), 669-682 (2007); Parr, T., Johnson, C., Hanson-Parr, D., Higa, K., and Wilson, K., "Evaluation of Advanced Fuels for Underwater Propulsion," in *Proc.* 39$^{th}$ *JANNAF Combustion Subcommittee Meeting*, Colorado Springs, Colo. (December 2003)] The peak reaction temperature for Al/$AgIO_3$ is limited by dissociation of the molten $Al_2O_3$ product, which generates a pressure of one atmosphere near 4000 K. [Glassman, I. and Yetter, R. A., *Combustion,* 4$^{th}$ Edition, Academic Press (2008)] Several gaseous species are produced in the volatilization of $Al_2O_3$, including Al, O, AlO, $Al_2O$, $O_2$, and $Al_2O_2$. [Glassman, I. and Yetter, R. A., *Combustion,* 4$^{th}$ Edition, Academic Press (2008); Glang, R., Chap. 1 in *Handbook of Thin Film Technology*, L. I. Maissel and R. Glang, (eds.), McGraw-Hill, New York (1970)] The AgI product is dissociated into atomic vapors.

For adiabatic reaction at constant volume, the aluminum oxide product would be predominantly molten $Al_2O_3$, with only a small amount of dissociation (limited by high pressure). Table 5 provides additional information on calculated reaction temperatures and pressures, showing the effect of sample confinement (constant volume calculation). The calculated vapor pressure for AgI is 110 MPa at 6300 K, and the total pressure would be roughly 150 MPa. [Johnson, C. E., Albro, W. R., Schilling, T. J., Higa, K. T., Gumina, J. M., and Tran, T. T., "Thermite Explosives," in *Proc.* 56*th JANNAF Propulsion Subcommittee Meeting*, Las Vegas, Nev. (April 2009); Johnson, C. E., Albro, W. R., Schilling, T. J., Higa, K. T., Gumina, J. M., and Tran, T. T., "Thermite Explosives," in *Proc.* 56*th JANNAF Propulsion Subcommittee Meeting*, Las Vegas, Nev. (April 2009)] However, AgI may be mostly dissociated at these high temperatures. For atomic iodine vapor and molten Ag products, the reaction temperature would be about 6000 K, and the pressure about 1500 MPa. The major end products were confirmed to be $Al_2O_3$ and AgI by SEM/EDX and XRD analysis, with some silver as a minor product. [Sullivan, K. T., Piekiel, N. W., Chowdhury, S., Wu, C., Zachariah, M. R., and Johnson, C. E., "Ignition and Combustion Characteristics of Nanoscale Al/$AgIO_3$: A Potential Energetic Biocidal System," *Combustion Science and Technology,* 183(3), 285-302 (2011)] Additional pressure could be generated from thermite material systems by adding gas-generating compounds (e.g., ammonium nitrate), or by mixing the thermites with air.

Scheme 1: Al + $AgIO_3$ System

Heat reactants (P = 1 atm):

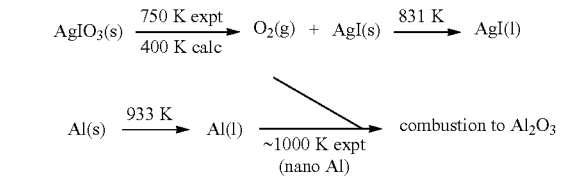

Cool products of adiabatic reaction (>4000 K):

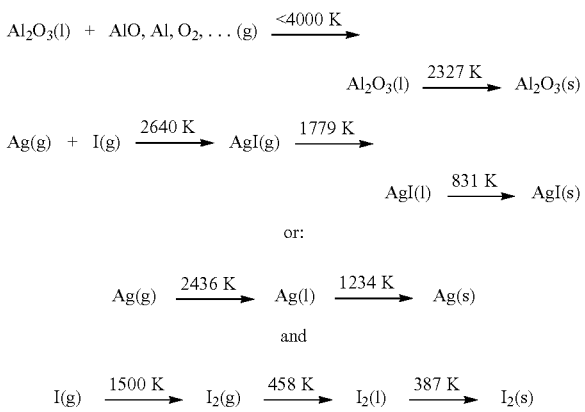

TABLE 5

Calculated reaction temperatures and pressures for two thermites and TNT.[a]

| Composition | Adiabatic T, K (0.1 MPa) | Adiabatic T, K (no gas) | Adiabatic T, K (const V) | P, MPa (const V) |
|---|---|---|---|---|
| 2 Al + $AgIO_3$ | ~4000 | 6300 | >5000 | 150-1500 |
| 2 Al + $Bi_2O_3$ | 3300 | 4750 | ~4200 | >130 |
| TNT | 2830 | not applicable | 2830 | 1500[b] |

[a]Conditions for the three adiabatic reaction temperatures are:

1) atmospheric pressure (0.1 MPa), 2) reaction products constrained to liquid phases (no gas), 3) constant volume system, starting with fully dense material.

[b]The pressure for TNT is for adiabatic deflagration (detonation pressure is an order of magnitude higher).

Material Characterization

Figure 8:
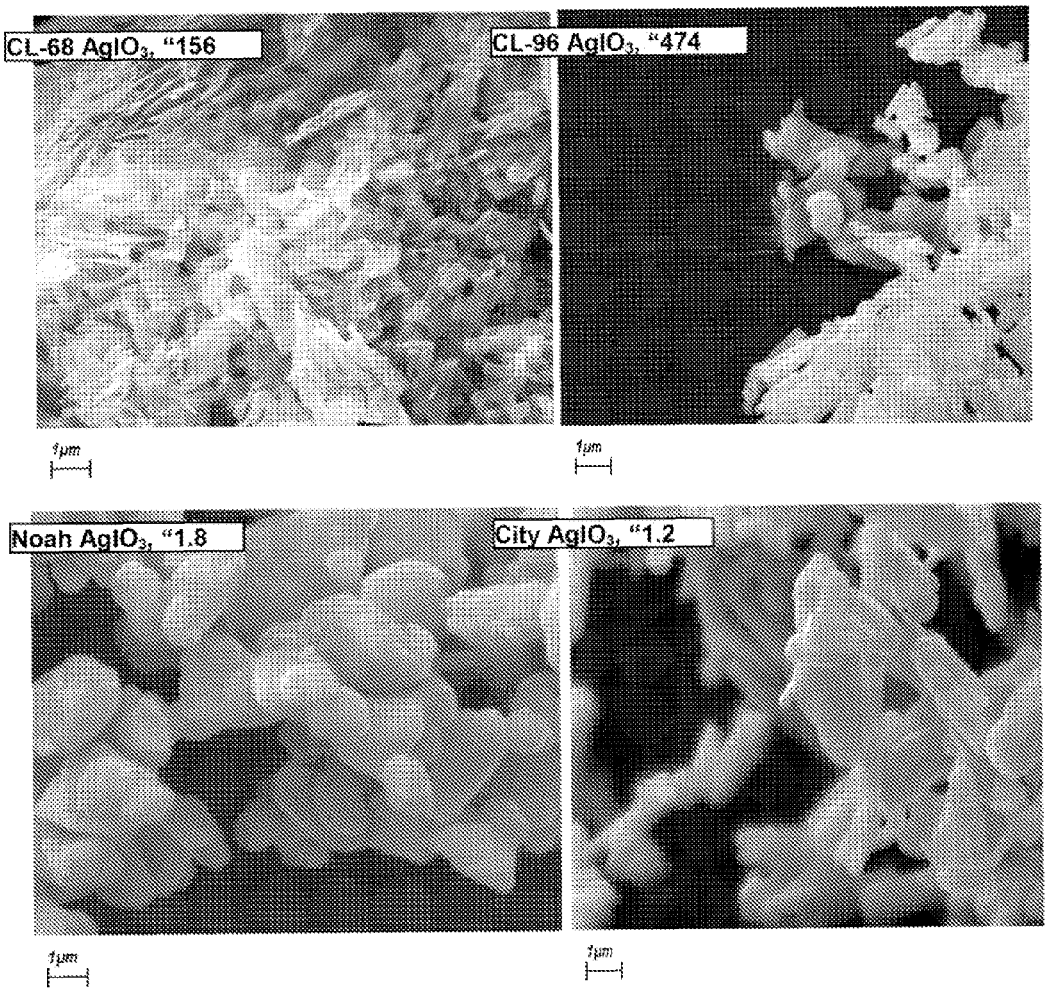
FIG. 8 are photographs illustrating scanning electron micrographs of two synthesized and two commercial $AgIO_3$ powders, according to embodiments of the invention.
Figure 9:
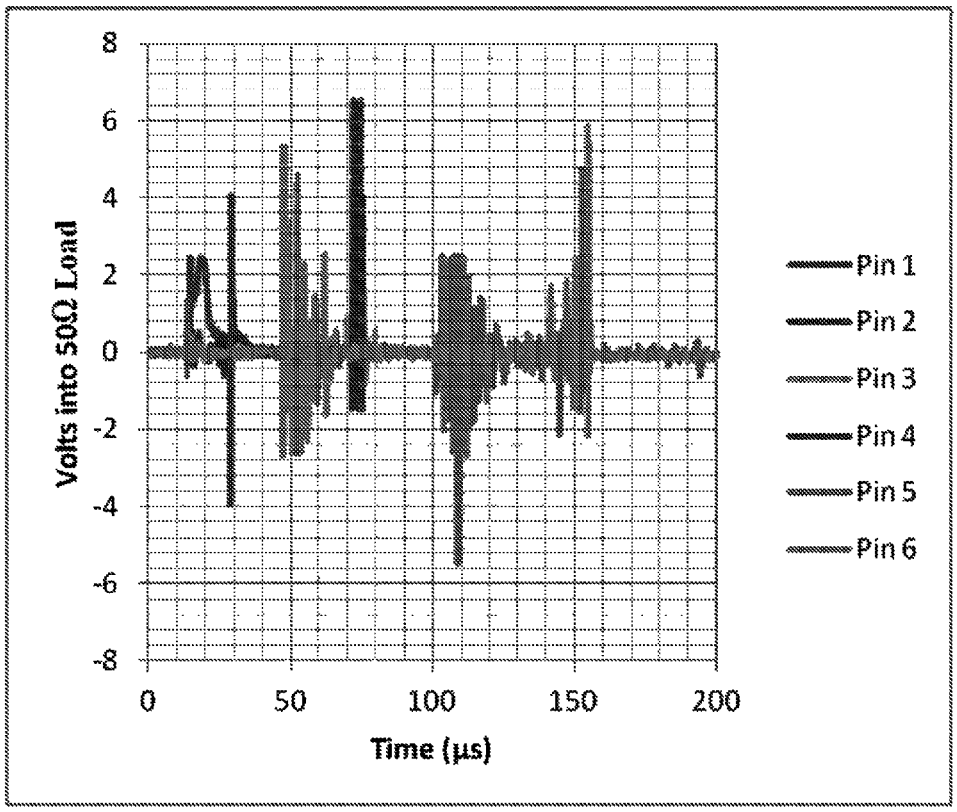
FIG. 9 is a graph illustrating the response of the piezoelectric time-of-arrival pins, according to embodiments of the invention.

Scanning electron micrographs of two synthesized and two commercial $AgIO_3$ powders are shown in FIG. 8. The synthesized materials (CL designations) formed platelets, while the commercial materials consisted of rather rounded particles. Additional information on several batches of the synthesized $AgIO_3$ is presented in Table 6. The isolated yield of product exceeded 100% in at least one case, indicating impurities from the excess $KIO_3$ used and from the $KNO_3$ byproduct. The amount of impurities was reduced by a combination of better mixing during the addition and more thorough washing of the product. FIG. 8. Scanning electron micrographs of silver iodate powders. The particle sizes listed were determined by surface area analysis, based on a geometry of uniformly sized spheres.

TABLE 6

Characteristics of synthesized batches of $AgIO_3$.[a]

| Sample | Scale, g | Size, nm[b] | % Yield | Density of Thermite in Hexane Suspension, g/cc[c] |
|---|---|---|---|---|
| CL-68 | 50 | 156 | 98.8 | not measured |
| CL-96 | 500 | 474 | 102.4 | 1.33 |
| CL-33 | 250 | 236 | 99.8 | 0.37 |
| CL-34 | 250 | 266 | 99.6 | 0.69 |
| CL-37 | 500 | 277 | 99.8-100.5[d] | 0.67 |

[a]The $AgNO_3$ solution was added to the $KIO_3$ solution for all samples except CL-33, where the addition was reversed.
[b]The average particle size was determined from the specific surface area, based on a geometry of uniformly sized spheres.
[c]The density of thermites prepared with 80 nm Al were determined from samples suspended in hexanes after allowing the solid to settle for several hours.
[d]Range due to uncertainty in the mass of $AgNO_3$ used.

The reactivity of nanothermites was characterized by video imaging and a small-scale dent test. The peak brightness of the fireball occurs at approximately 25 μs. The peak temperature of the fireball is near 3400 K, based on optical pyrometry measurements. [Johnson, C. E., Higa, K. T., Albro, W. R., and Harvey, B. G., "Fuel-Rich Thermites," in *Proc.* 43rd *JANNAF Combustion Subcommittee Meeting*, La Jolla, Calif. (December 2009)] Thus, the rate of temperature rise in the sample is about $10^8$ K/s. The linear propagation rate of combustion in a powder including 271 nm $AgIO_3$ was measured to be 640 m/s by spark igniting one end of a line of powder on an aluminum weighing pan. [Johnson, C. E., Higa, K. T., Albro, W. R., and Harvey, B. G., "Fuel-Rich Thermites," in *Proc.* 43rd *JANNAF Combustion Subcommittee Meeting*, La Jolla, Calif. (December 2009)] When the much larger 1200 nm $AgIO_3$ was used along with the same 80 nm Al, the propagation rate was reduced by less than 10% to 600 m/s. These results are consistent with rapid initial thermal decomposition of the $AgIO_3$, releasing oxygen that reacts with the Al. [Sullivan, K. T., Piekiel, N. W., Chowdhury, S., Wu, C., Zachariah, M. R., and Johnson, C. E., "Ignition and Combustion Characteristics of Nanoscale Al/$AgIO_3$: A Potential Energetic Biocidal System," *Combustion Science and Technology,* 183(3), 285-302 (2011)]

In the small-scale dent tests, 5-50 mg samples were placed on inverted aluminum weighing pans, and ignited with the spark from a Tesla coil. The $AgIO_3$ and $Bi_2O_3$ nanothermites readily blasted holes in the aluminum weighing pans using 10-15 mg samples. By reducing sample size, dents were produced in the weighing pans, and the dent depth provided a quantitative measure of material performance. The fuel to oxidizer ratio (equivalence ratio) was optimized using this test. Table 7 lists the optimized results for both sonicated and ball milled samples. Video images indicate that the dent or hole in the pan forms approximately 20 μs after the start of ignition of Al/$AgIO_3$ nanothermite, essentially matching the time of peak brightness of the fireball. The working gas that produces the dent or hole in the pan is likely a combination of the expected products of adiabatic reaction, along with intermediate species formed by volatilization and/or decomposition of the starting materials (e.g., $O_2$ in the case of Al/$AgIO_3$). The high rate of propagation of many nanothermites has been attributed to a convective wave reaction mechanism, where hot gaseous species transfer heat to unreacted material. [Bockmon, B. S., Pantoya, M. L., Son, S. F., Asay, B. W. and Mang, J. T., "Combustion Velocities and Propagation Mechanisms of Metastable Interstitial Composites," *J. Appl. Phys.* 98, 064903-1 to 064903-7 (2005); Sanders, V. E., Asay, B. W., Foley, T. F., Tappan, B. C., Pacheco, A. N. and Son, S. F., "Reaction Propagation of Four Nanoscale Energetic Composites (Al/$MoO_3$, Al/$WO_3$, Al/CuO, and $Bi_2O_3$)," *Journal of Propulsion and Power,* 23(4), 707-714 (2007)]

Video images of spark initiated reactions of Al (80 nm)+ $AgIO_3$ (270 nm) nanothermite were reviewed at 24,000 frames per second (42 μs frame interval) and at 80,000 frames per second (12.5 μs frame interval). Exposure time 2 μs for both experiments.

TABLE 7

Pan dent test results for thermite composites.[a]

| Aluminum Size, nm | Oxidizer (size) | Sonicated Equivalence Ratio | Deflection mm/g | Ball Milled Equivalence Ratio | Deflection mm/g |
|---|---|---|---|---|---|
| 150 | $MoO_3$ (45 nm) | 1.52 | 11 | 1.34 | 184 |
| 80 | $MoO_3$ (45 nm) | 1.34 | 156 | 1.26 | 154 |
| 150 | $Bi_2O_3$ (320 nm) | 1.14 | 463 | NA | NA |
| 80 | $Bi_2O_3$ (320 nm) | 1.13 | 483 | 1.13 | 438 |
| 150 | $AgIO_3$ (156 nm) | 1.12 | 0 | 1.12 | 756 |
| 80 | $AgIO_3$ (1800 nm) | 1.12 | 450 | NA | NA |
| 80 | $AgIO_3$ (1200 nm) | 1.10 | 792 | NA | NA |
| 80 | $AgIO_3$ (632 nm) | 1.15 | 1007 | 1.16 | 1048 |
| 80 | $AgIO_3$ (474 nm) | 1.10 | 1050 | 1.09 | 1219 |
| 80 | $AgIO_3$ (277 nm) | 1.07 | 973 | 1.10 | 1308 |
| 80 | $AgIO_3$ (266 nm) | 1.04 | 1069 | 1.08 | 1100 |
| 80 | $AgIO_3$ (236 nm) | NA | NA | 1.09 | 970 |
| 80 | $AgIO_3$ (181 nm) | 1.06 | 1124 | NA | NA |
| 80 | $AgIO_3$ (156 nm) | 1.00 | 1009 | NA | NA |

[a]NA indicates data not available.
The thickness of the Al pan material is 0.11 mm.

The pan test results in Table 7 show that the ball milling mixing procedure was generally more effective than sonication at producing higher reactivity materials. The difference is most dramatic for the samples with the 150 nm Al and $MoO_3$ and $AgIO_3$, where very little or no dent was produced by the sonicated material. The highest dent values were obtained for the ball milled 80 nm Al with 277 and 474 nm $AgIO_3$. A likely explanation is that the ball milling process is breaking up clumps of both the Al (especially for the 150 nm size) and the oxidizer (especially for the $AgIO_3$, where the SEM micrographs show stacking of platelets). While the ball milling was generally run overnight (16-24 h), essentially the same results were obtained after 6 h of ball milling with the 474 nm $AgIO_3$. Among the 100 g scale ball milled preparations, the average pan test performance was highest for the material with 277 nm $AgIO_3$ (average of 1276 mm/g for 6 batches), followed by a material with 474 nm $AgIO_3$ (1219 mm/g for one batch), followed by the material with 266 nm $AgIO_3$ (average of 1101 mm/g for 3 batches), and followed by a material with 236 nm $AgIO_3$ (970 mm/g for one batch). The densities of the suspended powders varied by greater than a factor of 3, as shown in Table 3. To maintain sample uniformity, the larger scale shock to detonation test used samples from the 277 and 266 nm $AgIO_3$. The sample with the 236 nm $AgIO_3$ was excluded from explosive testing due to its low density and pan dent value. The lower performance is possibly related to the reverse addition preparation procedure, but no cause and effect has been established. The high density, high performance sample with 474 nm $AgIO_3$ would be a good candidate for further explosive testing.

Tests of Shock to Detonation of $Al/AgIO_3$ Nanothermite

Materials and Handling Requirements

The first test used 500 g of $Al/AgIO_3$ nanothermite that contained a mixture of 80 nm and 150 nm Al. The second test used 800 g of an optimized formulation (designated AE95) of $Al/AgIO_3$ that contained only the 80 nm Al. Due to the high ESD and friction sensitivity of these materials in the dry state (where they are treated as primary explosives), the samples were kept wet with hexanes until the test setup was complete and the firing bay was vacated. When wet with hexane, the reactivity of the material is reduced to that of a flammable solid. The drying of the material and any further test preparations were conducted remotely, creating certain challenges that are discussed below in the test descriptions.

Formulation AE95 is 22 wt % 80-nm aluminum powder and 78 wt % silver iodate (equivalence ratio 1.10). AE95 has been initiated with Tesla coil discharge; the reaction was rapid and quantified via a small scale dent test that witnesses the reaction in a thin aluminum structure. High performance in this test, with an average dent value of 1219 mm/g, made it the prime candidate for shock initiation to detonation experiments.

Initial Test of Shock to Detonation on 500 g of $Al/AgIO_3$ Nanothermite

A 500 g detonation test resulted in deflagration of the nanothermite, based on the observation of only a minor depression on the aluminum witness block. The nanothermite included voids and large cracks due to shrinkage from drying of hexane from the mixture, which was loaded as a hexane suspension due to the high sensitivity of the dry nanothermite. Similar cracks in aluminum/ammonium nitrate formulations were large enough to disrupt detonation initiation and propagation, so this could explain the failure of the $Al/AgIO_3$ to propagate a detonation wave. A detonation test was 500 g of $Al/AgIO_3$ nanothermite.

Shock to Detonation Test on 800 g of $Al/AgIO_3$ Nanothermite

Test Fixture

Based on the results of the 500 g test, it was recognized that a remote means to "compress" the nanothermite was necessary to reduce fissures in the bed of energetic. In this experiment, a fixture was constructed that lowered a Teflon™ block onto the nanothermite, compressing it. Teflon™ was chosen because it would slide in the guide area of the fixture and it has nearly the same density as aluminum. As in the previous experiment, the nanothermite was contained in an aluminum housing as shown in FIG. 11*a*.

Shown at the base of the fixture in FIG. 11*a* is a household heating pad. This low energy appliance was used to evaporate the hexanes quickly without overheating the material. Hexanes rapidly evaporate under the conditions of the test, and the additional heat energy increased the rate. The holes at the top of the fixture allowed the gaseous hexanes to escape.

The booster used to induce shock to detonation was a 220 g (2 in W×5 in H) sheet explosive charge as shown in FIG. 11*b*. The thickness of the sheet explosive charge was 19 mm. Three points of initiation were facilitated by RP-80 exploding bridge wire detonators, equally spaced on the booster charge. The detonators were in series with the firing unit. The detonation of the sheet explosive transmits a shock through the aluminum housing into the AE95.

Transfer of the AE95 to the test fixture was difficult. Ten bottles each containing 100 g of AE95 constituted the starting material. It was necessary to maintain the AE95 in a damp state for safety. This was done with the use of wash-bottles and pipets. Transfer of the AE95 proceeded by washing the material out of the bottle. Some of the material could not be efficiently removed from the small bottles without significant drying occurring. This material was re-damped and set aside. In the end, approximately 800 g of AE95 was transferred to the fixture. Excess hexanes were removed with a pipet. After the evaporation of the damping liquid and lowering of the Teflon™ compression block, the final volume was approximately 1350 $cm^3$. This gave a final approximate density of 0.6 g!$cm^3$ (12.7% Theoretical Maximum Density). After the AE95 was loaded into the fixture, the booster was attached. the Teflon™ compression block was placed in a ready position, personnel left the firing bay, and the heating appliance was activated. The firing bay exhaust fans remained on for the 6.5 hours of drying time. The final configuration is shown in FIG. 11*c*. The Teflon™ compression block was positioned just above the holes at the top of the fixture. This was to allow the solvent vapor to escape.

FIGS. 11*a-c*. (a) Fixture in preparation and alignment stages. The fiber optic cables are orange. The Teflon compression block had a mass of about 3 kg and was supported with Nylon rope passing over a series of pulleys. This allowed the lowering from a safe location. (b) The booster system used to initiate a shock wave in the nanothermite. Each layer of sheet explosive is approximately ¼ inch thick for a net thickness of about 19 mm. The detonators were located at equidistance. (c) The experimental configuration just prior to leaving the firing bay. Not shown are the piezoelectric pins on the opposite side of the fixture. There is a ground strap of copper on the lower right side that was used to keep the electrical potential of the fixture at ground.

Diagnostics and Witness Plates

The soft aluminum witness block, making up the base of the fixture, would offer evidence that the mass velocity and the reaction wave velocity were in the same direction by generating plastic deformation in the metal.

The distance-time trajectory of the reaction wave through the nanothermite would be measured with the piezoelectric pins. Piezoelectric pins used where the shock waves are weak can be troublesome. The signal from each pin was recorded on a separate oscilloscope channel where it was terminated in 50 Ω in order to avoid transmission line reflections. Each of the pins protruded into the AE95 approximately 1.27 cm.

Opposite the piezoelectric pins were located five optical pyrometers, constructed from stock items purchased through Thorlabs, which were used to measure the temperature of the AE95. Each pyrometer consisted of a beam splitting cube, two optical filters (one infrared and one visible), and two reversed-biased silicon photodiodes. Light was directed into the pyrometers via stock 600 μm bifurcated fiber optic cables from Ocean Optics. The bifurcated cables were coupled to 5 m long, 600 μm diameter stock fiber optic patch cords purchased from Thorlabs. These cables were glued into the test fixture using epoxy, with a final protrusion of 1 mm into the nanothermite sample. The distance between each fiber in the fixture is shown in Table 8. All fiber optic patch cords, bifurcated cables, and beam splitting cubes were selected to have excellent light transmission in the region of the infrared and visible filters. The photodiode detectors also had excellent response in the region of interest. Finally, a single unbiased photodiode was employed without any filters, to detect the onset of the reaction.

The single photodiode was placed in the test fixture at position 1, with the five pyrometers placed consecutively in the remaining positions. The output from each photodiode detector was sent to a LeCroy Wavesurfer 454 Digital oscilloscope, set to trigger on the detonator firing pulse. Each channel was band-width limited to 20 MHz, DC coupled to a 50 Ohm termination, with a vertical scale of 500 mV per division, and a horizontal scale set to 50 μs per division. The data acquisition rate was set to maximum available rate.

TABLE 8

Fiber distanced from outside face of aluminum block.

| Position | Distance from Aluminum Face (mm) | Instrument |
|---|---|---|
| 1 | 21.1 | Photodiode |
| 2 | 53.9 | Pyrometer 1 |
| 3 | 87.9 | Pyrometer 2 |
| 4 | 121.9 | Pyrometer 3 |
| 5 | 157.1 | Pyrometer 4 |
| 6 | 188.8 | Pyrometer 5 |

Reaction Wave Velocity Determination

The response of the piezoelectric pins is shown in FIG. 12. There was some cross-communication between the pins, which is the primary reason for the use of oscilloscopes to record the signal. If the pin signals are obscured by noise, it is sometimes possible to sort-out the time-of-arrival. As seen in FIG. 5, some of the pins were ringing subsequent to the passage of the shock wave. In the case of position six, the last pin, the shape of the signal suggests a dispersed shock wave.

FIG. 10*a* shows the distance time trajectory. The reaction wave is decreasing in speed. These data were fitted to a polynomial from which the velocity can be calculated, see FIG. 10*b*. This suggests that the reaction was either over-driven to the extent that it could not decay to a steady-state value or no detonation could be achieved.

FIG. 11. Response of the piezoelectric time-of-arrival pins. The incident times were taken at approximately 2 V. Pins 1-5 are typical for these types of tests—there is a clear start time, followed by a ringing decay or a rapid shut-off. Pin 6 rang-up. The hypothesis is that the shock wave dispersed. Nonetheless, the wave speed was continuously decreasing.

FIGS. 10*a* and *b*. (a) The distance-time trajectory of the reaction wave in the nanothermite. The choice of the polynomial to represent the data was based on the requirement that it have zero-position at zero-time. The second order polynomial fit well, a third order polynomial had a better correlation coefficient, but not of statistical significance, so its application was unjustified. (b) The calculated reaction wave velocity. The initial velocity of the reaction wave through the nanothermite was over 2 mm/μs, which decayed to less than 0.5 mm/μs. It is unknown if this is below the acoustic speed in the material, but considering the hypothesized dispersion of the shock wave at the piezoelectric pin in position 6, is seems reasonable.

Witness Plate Results

The witness plate had no plastic deformation. There exists no physical evidence that a detonation was achieved, or the pressure was well below the plastic region for aluminum. Parts of the fixture remaining after the test. The witness plate scaring was the result of the booster function. Welds were sheared.

Pyrometry Results

All three scopes successfully triggered with the firing pulse. No usable data was recorded from pyrometers 1, 2, 3, and 5. It is hypothesized that because the reaction did not run to detonation, insufficient light was produced for detection by the photodiodes. By terminating the photodiode detectors at 50 Ω, a significant amount of light is required before an output voltage is detected. But this is necessary in order to avoid reflections in the transmission cables. Terminating in 1 MΩ provides a greater response but affects the signal duration.

The output of the single photodiode, located at position 1, is shown in FIG. 11*a*. The photodiode captured light from the reaction at 25 μs, 76.5 μs, 124 μs, and 142.5 μs. None of these times correspond with the passage of the shock wave, indicating that the light output was due to material combusting long after the shock wave had passed. The presence of the shock wave would have been noted by a large, very sharp increase in detectable light. The peaks shown here have a more gradual increase.

Pyrometer 4 detected enough light to calculate a temperature, the profile of which is shown in FIG. 11*b*. The shock wave passed this position at 103 μs, approximately the same time at which the piezoelectric pin at this position detected the passage of a shock wave. The temperature quickly rose to a peak of 3400 K at 106 μs, and then fell to a steady state temperature of around 2700 K. The steady state duration was nearly 300 μs. Near the end of the record, the temperature rose to a maximum of 3150 K before falling as the record ended. The final temperature peak duration was nearly 50 μs. while the first temperature peak was only 10 μs in duration.

FIGS. 11*a* and *b*. (a) The response of the photodiode in position 1. Signal spikes were observed but they did not correspond to any responses of the piezoelectric pins. At 0 μs the detonator was functioned. (b) The temperature as determined by the pyrometer at position 5. The data between 0-100 μs was truncated, because its response was noisy and had no physical meaning. The response time of this pyrometer corresponded to the piezoelectric pin opposite to it.

The temperatures were calculated from the ratio of the voltage outputs of Channels 1 and 2 of the pyrometer. This ratio was then inserted into Wien's gray-body approximation, along with the filter wavelengths to output a temperature. This temperature data should be considered raw, as it has not been corrected to include the instrument response function for the pyrometer.

SUMMARY AND CONCLUSIONS

The shock to detonation experiments did not support the hypothesis that a nanothermite of aluminum/silver iodate, in particular AE95, can be shock initiated to a detonation. This does not preclude that the condition can be achieved with this material in a fixture with larger dimensions, a different formulation of the reactants, an alternative booster, etc. Over-driven conditions may have prevented efficient initiation of this nanothermite. Future experiments should focus on reduced shock pressure initiation conditions. Higher density $Al/AgIO_3$ samples should be tested. It is also suggested that high speed rotating mirror framing cameras be used with framing times of at least 750,000 frames/second. A mild ball milling procedure gave superior materials to those mixed with an ultrasonic horn. While the $Al/AgIO_3$ nanothermite material exhibits blast effects in the pan dent test, the relatively low propagation rate and condensable nature of gaseous products limit its ability to do pressure-volume work. Additional pressure could be produced by using gas-generating additives, or by mixing the thermites with air. The explosive behavior of thermites is still at an early stage of characterization.

Prophetic examples are for illustration purposes only and not to be used to limit any of the embodiments.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. An energetic composite prepared by the process, comprising:

utilizing a modified ball milling process within a chamber capable of producing energetic composites greater than 2 grams, wherein said chamber comprises of high density polyethylene and having at least one friction control mechanism;

adding in said chamber at least one submicron sized metal fuel powder and at least one oxidizer powder, and at least one non-polar solvent; and placing chamber on a rotation device having a rotation rate of about 60 to about 200 rpm depending on fuel and oxidizer materials utilized to produce energetic composites.

2. The composite of claim 1, wherein said milling balls are constructed of materials having ceramic, metal, or metal alloy including steel.

3. The composite of claim 1, wherein said chamber comprises of a soft walled material including polyethylene.

4. The composite of claim 1, wherein said chamber comprises of a soft walled material including high density and low density polyethylene.

5. The composite of claim 1, wherein said chamber comprises of a soft walled material including plastics, rubbers, and fluoropolymers.

6. The composite of claim 1, wherein said metals comprises at least one of titanium, boron, magnesium, aluminum, zinc, zirconium, and/or hafnium.

7. The composite of claim 1, wherein said metals comprises of a particle sizes having ranges of about 33 nm to about 200 nm.

8. The composite of claim 1, wherein said metal-oxides comprises at least one of $MoO_3$, $Bi_2O_3$, $AgIO_3$, $Ag_2O$, $Ag_2MoO_4$, CuO, $Fe_2O_3$, $Fe_3O_4$, $MnO_2$, $Bi(IO_3)_3$, $MIO_3$ (M=Li, Na, K), $I_2O_5$, and/or $I_2O_6$.

9. The composite of claim 1, wherein said metal-oxides comprises of particle sizes having ranges of about 10 nm to about 10 microns.

10. The composite of claim 1, wherein said non-polar solvent comprises of at least one organic solvent including hexane(s).

11. The composite of claim 1, wherein said non-polar solvent comprises of alkanes, aromatics, fluorocarbons solvents, and/or acetones.

* * * * *